US005165790A

United States Patent [19]

Boschetto

[11] Patent Number: 5,165,790

[45] Date of Patent: Nov. 24, 1992

[54] WINDOW MOUNTED LIGHT FIXTURE

[76] Inventor: Andrew Boschetto, 11 Jamie Dr., Sewell, N.J. 08080

[21] Appl. No.: 828,148

[22] Filed: Jan. 30, 1992

[51] Int. Cl.[5] ..... F21V 21/08

[52] U.S. Cl. ..... 362/396; 362/253; 362/255; 362/351; 362/355; 362/448; 248/300; 211/87

[58] Field of Search ..... 362/253, 255, 256, 351, 362/352, 353, 355, 396, 434, 435, 436, 437, 448, 450; 248/300; 211/87

[56] References Cited

U.S. PATENT DOCUMENTS

| | | | |
|---|---|---|---|
| D. 320,864 | 10/1991 | Boschetto | D26/96 |
| 1,293,674 | 2/1919 | Black | 362/255 |
| 2,676,778 | 4/1954 | Pace et al. | 248/300 |
| 3,166,863 | 1/1965 | Gray | 248/300 |
| 3,578,282 | 5/1971 | Olsen | 362/396 |
| 3,599,918 | 8/1971 | Patchett | 362/396 |
| 4,315,633 | 2/1982 | Boeddeker et al. | 280/79.3 |
| 4,392,191 | 7/1983 | White, Sr. | 362/392 |
| 4,468,721 | 8/1984 | Vandrilla | 362/392 |
| 4,758,936 | 7/1988 | Maxwell | 362/434 |
| 4,795,121 | 1/1989 | Comito | 248/300 |
| 4,932,538 | 6/1990 | Gambello | 211/87 |

*Primary Examiner*—Ira S. Lazarus
*Assistant Examiner*—Y. Quach
*Attorney, Agent, or Firm*—Longacre & White

[57] ABSTRACT

A light support structure for mounting in a window a light fixture and shade. The embodiment of the present invention overcomes the difficulties encountered with narrow windowsills by providing a bracket with a thin, flat first portion for insertion into a space at the interface of a windowsill and window, and a light socket receiving second end onto which is mounted a semi-translucent light shade. The arrangement of the present invention permits both a stable support for the light fixture and quick and easy interchangeability of ornamental light shades.

13 Claims, 2 Drawing Sheets

FIG. 3
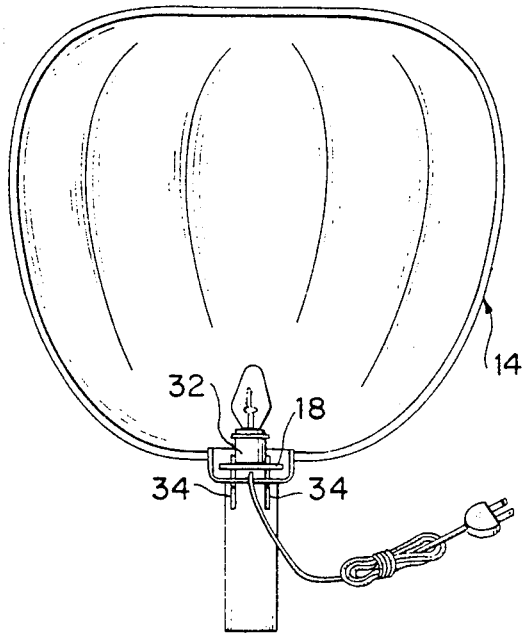
FIG. 5
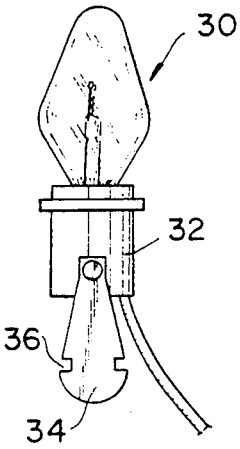
FIG. 4
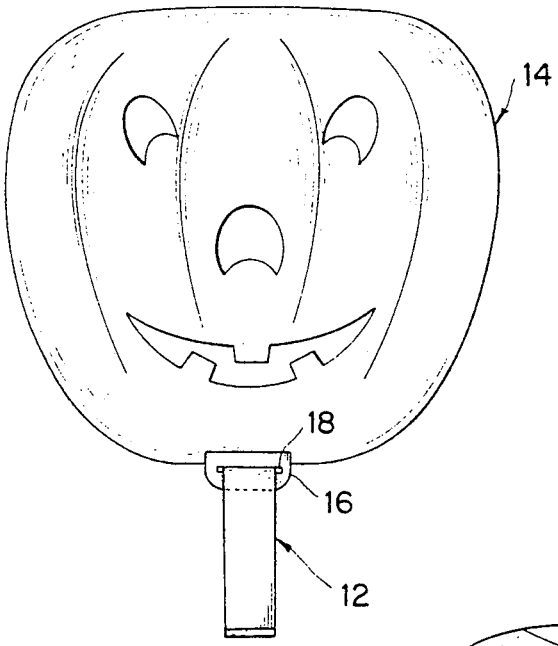
FIG. 7
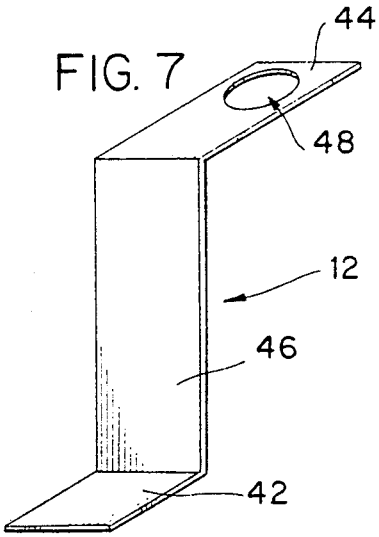
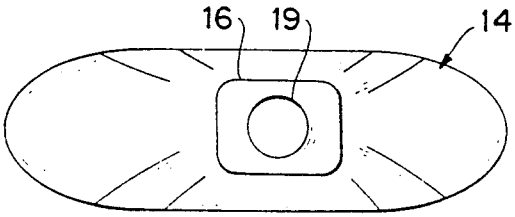
FIG. 6

WINDOW MOUNTED LIGHT FIXTURE

BACKGROUND OF THE INVENTION (a) Field of the Invention

The present invention pertains to a bracket for mounting a light fixture in a window. The structure of the bracket permits light shades to be interchangeably mounted thereto.

(b) Description of Related Art

Particularly at holiday times, electric lights and the like are placed upon windowsills for decoration. Difficulties are encountered in that these lights do not have adequate support to prevent them from falling off the windowsill. In addition, in the event that the window in question has a narrow sill, the use of such ornamental lights is precluded.

Various means have been proposed to secure such lights in position upon a windowsill. Many people have resorted to taping the lighting device to windowsills and/or taping the lights themselves to the window. Others have employed the use of safety fasteners to serve as supplementary support. However, generally such means are either unattractive, cumbersome to use, or quite expensive.

These problems encountered with having a candle or the like mounted on a windowsill have been recognized. Attempts have been made to solve these problems by incorporating a securing device or stabilizer wedged between the window and sill and attached to the lighting device. U.S. Pat. No. 4,468,721 to Vandrilla attempts to solve the aforementioned problem by utilizing a leash to secure a candle to a window. However, the arrangement taught by Vandrilla fails to provide a self-supporting light support structure for use with narrow windowsills. U.S. Pat. No. 4,392,191 to White, Sr. teaches a windowsill stabilizer for a candle. However, White, Sr. also fails to provide a self-supporting light support structure. In addition, U.S. design Pat. No. D320864 to the applicant of the instant invention discloses a window mounted electric candle having a bracket which is inserted between a windowsill and window to support a candle. With these prior art securing devices, a window mounted light support structure, permitting quick and simple interchangeability of light shades regardless of windowsill structure, has not been realized.

SUMMARY OF THE INVENTION

It is the object of this invention to provide a light support structure which overcomes the aforementioned problems. By utilizing a bracket which fits between the window and the sill, a quick and stable means is provided for mounting a light in a window regardless of the size of the sill.

It is also the object of the instant invention to provide a lighting device which needs no additional base structure for support.

Another object is to provide a lighting device which permits the quick and easy change of light shading devices; thus, different ornamental light shades can been interchanged for various holidays or special occasions.

Another object of the instant invention is to provide a novel bracket arrangement which utilizes a clip for manually changing the light shade when desired.

According to the principals of the instant invention, a light support structure is provided for mounting in a window various combinations of light/shading arrangements. Installation is accomplished by fitting a bracket between a window and a sill. This bracket serves to independently support the light fixture and shade; thus, it can be used regardless of windowsill type.

In addition, the light support structure permits the quick and simple interchangeability of light shades.

BRIEF DESCRIPTION OF THE DRAWINGS

FIG. 3 is a sectional view of the electric light and shade taken along section 3—3 of FIG. 2.

FIG. 4 is a front view of the light support bracket and shade of the type shown in FIGS. 1–3.

FIG. 5 is a side view of the light socket/clip device of the present invention.

FIG. 6 is a bottom view of the shade shown in FIGS. 1–4.

FIG. 7 is an isometric view of the bracket of the present invention.

DESCRIPTION OF THE PREFERRED EMBODIMENT

Figure 1:
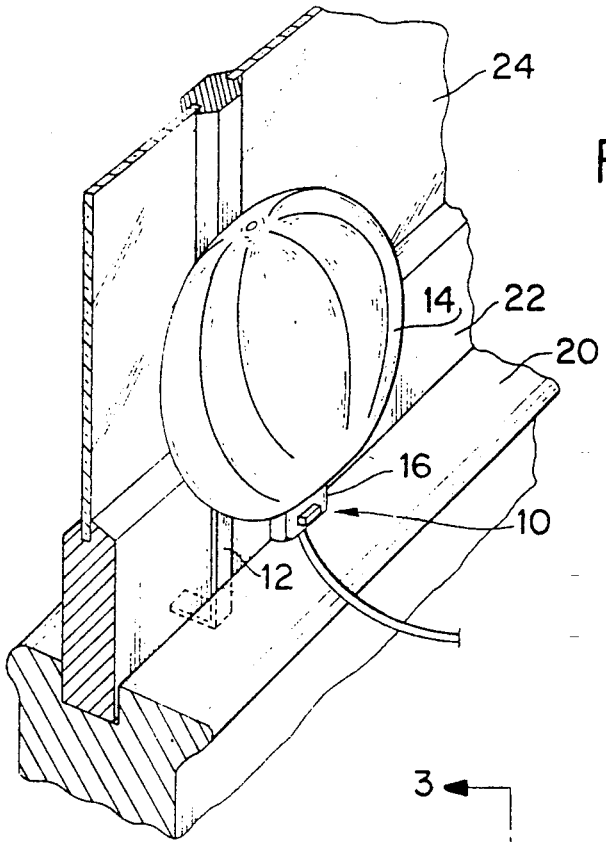
FIG. 1 is an isometric view of the light support assembly of the present invention mounted on a windowsill.
Figure 2:
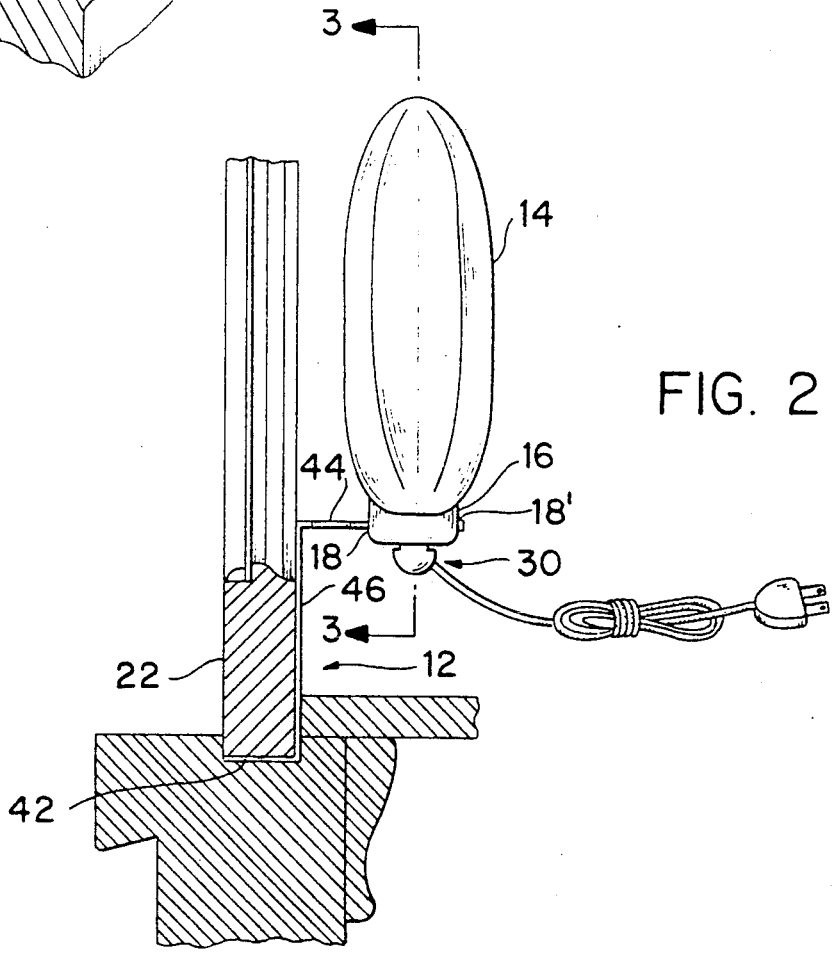
FIG. 2 is a partial sectional side view of a windowsill and window with an electric light and shade supported in the window by the assembly of the present invention.

Referring to FIGS. 1 and 2, a light fixture assembly 10 includes a bracket 12, a light shade 14, and a light socket/clip device 30. The light shade 14 and light socket/clip device 30 are supported by the bracket 12 so as to be displayed through the glass 24 of window 22.

The support bracket 12, in its preferred embodiment, is made of steel and takes a thin, flat shape as best shown in FIG. 7. To mount the assembly, one merely need open the window 22 enough to place the first end 42 of the bracket 12 between the window 22 and sill 20. Closing the window then force fits the bracket to the window. A central portion 46 of the bracket 12 is formed at a substantially 90 degree angle from the first end 42. Thus, the central portion 46 assumes a vertical orientation in the mounted position as shown in FIGS. 1 and 2. A second end 44 of bracket 12 is formed at a substantially 90 degree angle from the central portion 46 and serves as the portion on which the light fixture and shade are situated. The second end 44 assumes a horizontal orientation in the mounted position. This is also clearly shown in FIGS. 1 and 2.

With reference to FIGS. 2–4, the shade is mounted on the second end 44 through a slot 18 located in the mounting section 16 of the shade 14. As seen in FIG. 2, the second end 44 is received in the slot 18, continues through the mounting section 16, and exits the mounting section 16 through a second matching slot 18'. This arrangement situates the shade 14 in the window 22 in an upright position as shown in FIG. 1.

Once the shade 14 is situated on the second end 44 of the bracket 12, the light socket/clip device 30 is positioned on the bracket and shade in a manner which ensures a fastened assembly. This is accomplished by inserting the light socket and clip assembly 30, shown in FIG. 5, through an opening 19 located in the bottom of the shade 14. The light socket 32 then protrudes through a matching hole 48 in the second end of the bracket 12 as shown in FIGS. 3 and 7.

To ensure the stable mounting of the shade and light socket to the bracket, wing clips 34 are positioned on the socket 32. Wing clips of the type used are old and well known. The wing clip 34 are in the form of spring-steel flanges positioned on the socket 32 so as to naturally act in a spring-like fashion away from the socket. To mount the light socket and clip device within the shade, one merely need grasp the clips 34, squeezing them together. Once the light socket is properly situated within the shade, the clips 34 are released. The resilient action of the flanges cause the flanges to engage the shade. As shown in FIG. 5, the clips 34 are provided with slots 36, which engage the edges of the hole 19 when released, thus fastening the socket 32 to the shade 14. Because the socket is integral with the bracket through the matching hole 48, a stable arrangement is ensured taking the form as shown in FIGS. 1–4.

The light fixture assembly of this invention not only allows a light fixture assembly to be easily installed on, and removed from a window, but also has a pleasing, non-obtrusive appearance. Further, light fixture assemblies of this invention are easy and economical to manufacture and are quite effective in operation. In addition, the assembly of this invention permits the user to interchange light shades for various holidays or special occasions in a swift and trouble-free fashion.

While the invention has been particularly shown and described with reference to a preferred embodiment, it will be understood by those having ordinary skill in the art that various changes in form and detail may be made therein without departing from the spirit and scope of the invention.

We claim:

1. A light fixture assembly comprising:

an elongated bracket having a first end adapted for insertion at an interface between a windowsill and a window, and a second end adapted to receive a light socket;

said light socket receiving a light bulb and having a securing means;

a semi-translucent means for shading said light bulb, adapted to encapsulate said light bulb, and having a mounting section, said mounting section having an opening through which said second end is received, whereby said semi-translucent means is secured to said elongated bracket at said second end.

2. The light fixture assembly of claim 1 wherein said mounting section further comprises an aperture for receiving said light socket, said securing means being engaged at an edge of said aperture.

3. The light fixture assembly of claim 2 wherein said aperture is circular.

4. The light fixture assembly of claim 2 wherein said securing means comprises two resiliently biased flanges extending from said light socket for securing said light socket to said semi-translucent means.

5. The light fixture assembly of claim 1 wherein said elongated bracket further comprises a central portion located between said first and second ends at an angle with respect to said first and second ends.

6. The light fixture assembly of claim 1 wherein said first and second ends are substantially parallel.

7. The light fixture assembly of claim 1 wherein said socket light is received at said second end through an opening formed in said second end.

8. The light fixture assembly of claim 7 wherein said opening formed in said second end is circular.

9. A light fixture assembly comprising:

an elongated means for mounting said light fixture assembly having a first end and a second end, said second end being adapted to receive a light socket;

said light socket receiving a light bulb and having a securing means;

a semi-translucent means for shading said light bulb, having a mounting section, said mounting section having an opening through which said second end is received, and an aperture, orthogonal to said opening, said light socket being received through said aperture, whereby said securing means secures said semitranslucent means to said elongated means at said second end.

10. The light fixture assembly of claim 9 wherein said securing means is engaged at an edge of said aperture.

11. The light fixture assembly of claim 10 wherein said aperture is circular.

12. The light fixture assembly of claim 10 wherein said securing means comprises two resiliently biased flanges extending from said light socket for securing said light socket to said semi-translucent means.

13. The light fixture assembly of claim 9 wherein said light socket is received at said second end through an opening formed in said second end.

* * * * *